US006193487B1

(12) United States Patent
Ni

(10) Patent No.: US 6,193,487 B1
(45) Date of Patent: Feb. 27, 2001

(54) SCROLL-TYPE FLUID DISPLACEMENT DEVICE FOR VACUUM PUMP APPLICATION

(75) Inventor: Shimao Ni, Willowbrook, IL (US)

(73) Assignee: Mind Tech Corporation, Willowbrook, IL (US)

( * ) Notice: Subject to any disclaimer, the term of this patent is extended or adjusted under 35 U.S.C. 154(b) by 0 days.

(21) Appl. No.: 09/170,943

(22) Filed: Oct. 13, 1998

(51) Int. Cl.[7] ..... F01C 1/04; F01C 19/00

(52) U.S. Cl. ..... 418/55.2; 418/55.4; 418/141; 277/398

(58) Field of Search ..... 418/5, 55.1, 55.2, 418/55.4, 60, 104, 141, 142; 277/398

(56) References Cited

U.S. PATENT DOCUMENTS

| | | | | |
|---|---|---|---|---|
| 801,182 | | 7/1905 | Creux . | |
| 3,482,768 | | 12/1969 | Cirrincione et al. . | |
| 3,600,114 | | 8/1971 | Dvorak et al. . | |
| 3,802,809 | | 4/1974 | Vulliez . | |
| 3,874,827 | | 4/1975 | Young . | |
| 3,884,599 | | 5/1975 | Young et al. . | |
| 3,924,977 | | 12/1975 | McCullough . | |
| 3,989,422 | | 11/1976 | Güttinger . | |
| 3,994,633 | | 11/1976 | Shaffer . | |
| 3,994,636 | | 11/1976 | McCullough et al. . | |
| 4,063,855 | | 12/1977 | Paul . | |
| 4,082,484 | | 4/1978 | McCullough . | |
| 4,216,661 | | 8/1980 | Tojo et al. . | |
| 4,357,132 | | 11/1982 | Kousokabe . | |
| 4,411,605 | * | 10/1983 | Sauls | 418/55.4 |
| 4,437,820 | | 3/1984 | Terauchi et al. . | |
| 4,477,238 | | 10/1984 | Terauchi . | |
| 4,496,296 | | 1/1985 | Arai et al. . | |
| 4,512,729 | * | 4/1985 | Sakamoto et al. | 418/55.1 |
| 4,522,574 | | 6/1985 | Arai et al. . | |
| 4,527,964 | | 7/1985 | Mitsui et al. . | |
| 4,558,997 | | 12/1985 | Sakata et al. . | |
| 4,609,334 | | 9/1986 | Muir et al. . | |
| 4,611,975 | | 9/1986 | Blain . | |
| 4,642,034 | | 2/1987 | Terauchi . | |
| 4,676,075 | | 6/1987 | Shiibayashi . | |
| 4,869,658 | | 9/1989 | Tsutsumi et al. . | |
| 4,877,382 | | 10/1989 | Caillat et al. . | |
| 4,958,993 | | 9/1990 | Fujio . | |
| 5,035,589 | * | 7/1991 | Fraser, Jr. et al. | 418/55.4 |
| 5,102,316 | | 4/1992 | Caillat et al. . | |
| 5,178,529 | * | 1/1993 | Obrist et al. | 418/141 |
| 5,263,822 | * | 11/1993 | Fujio | 418/55.4 |
| 5,395,222 | | 3/1995 | Kawahara et al. . | |
| 5,458,471 | | 10/1995 | Ni . | |
| 5,547,354 | | 8/1996 | Shimizu et al. . | |
| 5,582,513 | | 12/1996 | Shigeoka et al. . | |
| 5,806,630 | | 9/1998 | Bernal . | |
| 5,833,443 | * | 11/1998 | Lifson | 418/55.2 |

FOREIGN PATENT DOCUMENTS

| | | | | |
|---|---|---|---|---|
| 2 255 595 | | 4/1992 | (GB) . | |
| 57-26205 | * | 2/1982 | (JP) | 418/60 |
| 60-98185 | | 6/1985 | (JP) . | |
| 61-116089 | * | 6/1986 | (JP) | 418/55.4 |
| 2-45672 | | 2/1990 | (JP) . | |
| 3-11102 | | 1/1991 | (JP) . | |
| 3-237283 | | 10/1991 | (JP) . | |
| 4-5490 | | 1/1992 | (JP) . | |
| 4-121482 | | 4/1992 | (JP) . | |
| 5-187371 | | 7/1993 | (JP) . | |

* cited by examiner

*Primary Examiner*—John J. Vrablik
(74) *Attorney, Agent, or Firm*—Brinks Hofer Gilson & Lione

(57) ABSTRACT

A scroll-type vacuum pump wherein an expander and a compressor are arranged in series, in two stages, in the same housing and driven by the same shaft. The first stage is a scroll-type expander. It is in series with a scroll-type compressor, which is the second stage. The volume of the suction pockets of the second stage, the compressor, is not significantly smaller than the volume of the discharge pockets of the first stage device, the expander. Thus, the amount of heat associated with the re-expansion and compression process is reduced. The two stage pump also includes a double shaft seal mechanism which seals off the suction chamber of the expander from both the ambient and the discharge chamber of the expander. The two stage pump of the invention further includes a labyrinth structure at the tip surfaces of the scroll elements to tightly control the axial gap between the tips and bases of the mating scroll elements.

12 Claims, 10 Drawing Sheets

SCROLL-TYPE FLUID DISPLACEMENT DEVICE FOR VACUUM PUMP APPLICATION

FIELD OF THE INVENTION

This invention relates in general to a fluid displacement device. More particularly, it relates to a scroll-type fluid displacement device for vacuum pump application.

BACKGROUND OF THE INVENTION

Scroll-type fluid displacement devices are well known. For example, U.S. Pat. No. 801,182 to Leon Creux, discloses a scroll device including two scroll members, each having a circular end plate and a spiroidal or involute scroll element. The scroll elements have identical, spiral geometry and are interfit with an angular and radial offset to create a plurality of line contacts between their spiral curved surfaces. Thus, the interfit scroll elements define and seal off at least one pair of fluid pockets. By orbiting one scroll element relative to the other, the line contacts are shifted along the spiral-curved surfaces, thereby changing the volume of the fluid pockets. This volume increases or decreases depending upon the direction of the scroll elements' relative orbital motion. Thus, the device may be used either to compress or expand fluids.

Known scroll-type fluid displacement devices, whether operating as expanders or compressors, can be used as vacuum pumps. However, both face a substantial potential for overheating.

Where an expander is used as a vacuum pump, ambient air will re-expand to the discharge pockets because the air pressure in the discharge pockets is much lower than the ambient air pressure. Re-expansion of ambient air in this fashion consumes energy and frequently causes overheating. A discharge valve can be employed to reduce re-expansion of the ambient air to some extent, but, it cannot eliminate re-expansion and such valves frequently malfunction.

When a compressor is used as a vacuum pump and the inlet air of the compressor is at atmospheric pressure during the start-up period, or due to leakage to ambient, the heat associated with the re-expansion and compression process is damaging to the compressor because there usually is no lubrication or internal cooling allowed. The re-expansion and compression heat causes excessive thermal growth of the scroll elements, resulting in galling between tips and bases of the scroll elements.

U.S. Pat. No. 3,994,636 discloses a tip seal mechanism for radial sealing between the compression pockets in a scroll-type fluid displacement device. In this device, as shown in the drawings as in FIG. 7, tip seals 101 and 201 are placed in spiral grooves 102 and 202 formed in the middle of the tips of a scroll vanes 103 and 203, respectively. These tip seals 101 and 201 run continuously along spiral grooves 102 and 202, from the central region to the periphery of the scroll members 103 and 203, respectively. The seals 101 and 201 are urged by either a mechanical device, such as elastic material, or by pneumatic force to contact the bases 204 and 104 of the other scroll member 203 and 103, respectively. This arrangement provides radial sealing. However, the width of the tip seal is smaller than the width of the scroll vane. There are tangential leakage passages A—A and B—B in scroll element 103, for example, at the both sides of the tip seal 101. These leakage passages lower the volumetric and energy efficiency of the scroll device.

SUMMARY OF THE INVENTION

It is a primary object of the present invention to overcome the above-mentioned shortcomings of a scroll-type fluid displacement device in a vacuum pump application.

It is also an object of the invention to provide a scroll-type vacuum pump wherein excessive heat normally associated with the re-expansion and compression process in such a device is eliminated.

It is another object of the invention to provide a scroll-type vacuum pump which achieves these ends by, among other things, utilizing an expander and a compressor in the same pump.

It is still another object of the present invention is to provide a shaft seal mechanism which seals off the suction chamber of the expander from both the ambient and the discharge chamber of the expander.

Yet another object of the present invention is to provide a seal arrangement at the tip of a scroll element which effectively provides radial and tangential sealing without tip-base galling.

The foregoing and other objects are realized in accord with the present invention by providing an expander-compressor, two stage vacuum pump, built in the same body and sharing the same drive shaft. The first stage is a scroll-type expander. It is in series with a scroll-type compressor, which is the second stage. The volume of the suction pockets of the second stage, the compressor, is not significantly smaller than the volume of the discharge pockets of the first stage device, the expander. Thus, the amount of heat associated with the re-expansion and compression process is reduced. The two stage pump also includes a double shaft seal mechanism which seals off the suction chamber of the expander from both the ambient and the discharge chamber of the expander.

The two stage pump of the invention further includes a labyrinth structure on the tip of each scroll element to tightly control the axial gap between the tips and bases of the mating scroll elements. The labyrinth structure comprises an arrangement of small lips, with thin and low walls, forming a maze on each tip of each of the scroll elements. When thermal growth of the scroll elements causes the labyrinth lips to press against the base of a mating scroll element, the labyrinth lips are sufficiently weak that the contact pressure between the lips and base deforms the lips on the scroll by removing interferencing material without causing tip or base galling. Thus, the labyrinth lips can produce an extremely close axial clearance between the scroll tips and bases. Radial and tangential leakage flow between compression pockets is significantly reduced because good radial and tangential sealing is achieved.

BRIEF DESCRIPTION OF SEVERAL VIEWS OF THE DRAWINGS

The invention, including its construction and operation, is illustrated more or less diagrammatically in the drawings, in which.

DETAILED DESCRIPTION OF THE PRESENTLY PREFERRED EMBODIMENTS

Figure 1:
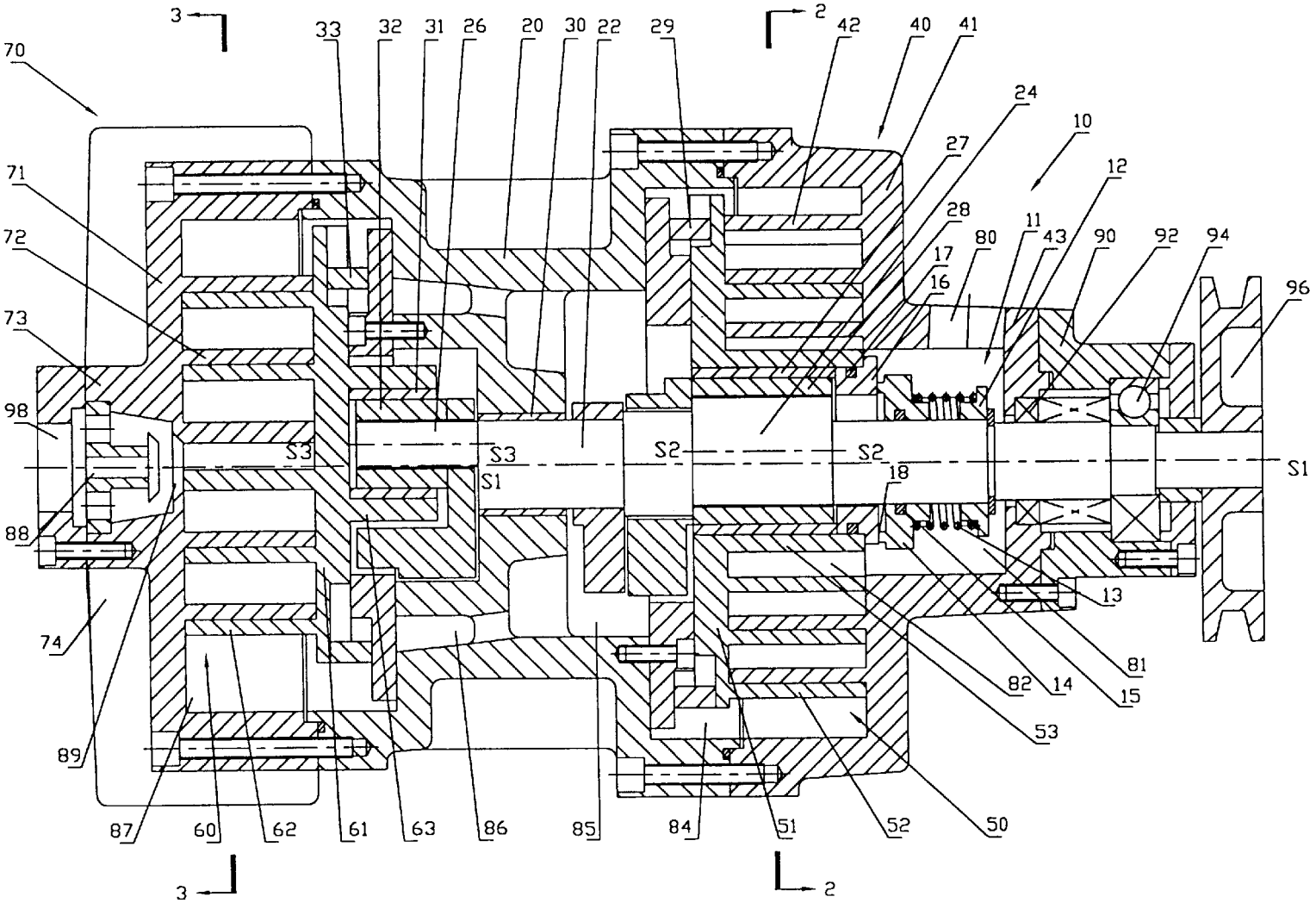
FIG. 1 is a cross-sectional view along the axis of a two stage, scroll-type vacuum pump constructed in accord with the present invention.
Figure 2:
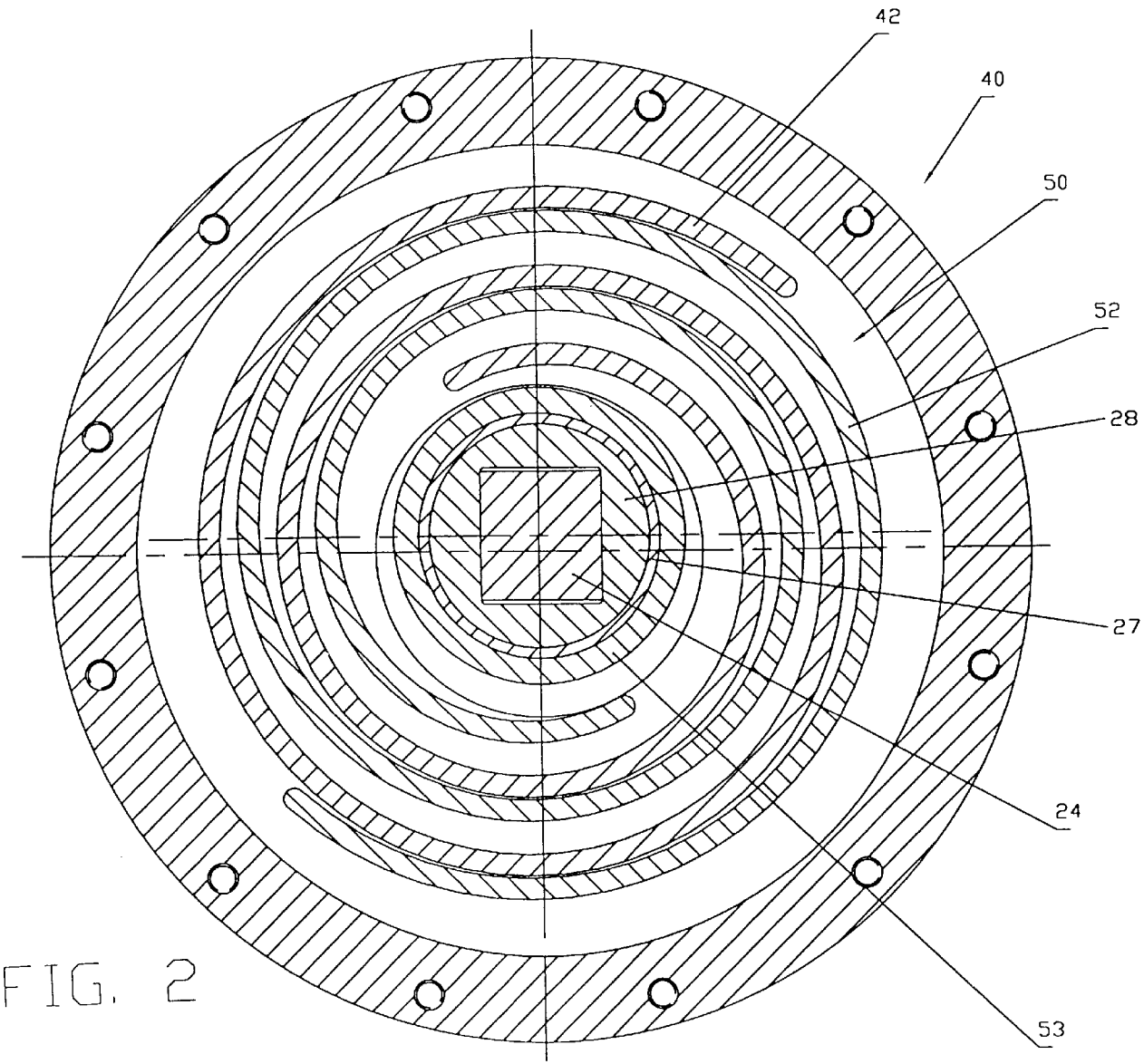
FIG. 2 is a cross-sectional view taken transversely through the pump of FIG. 1 along line 2—2 of FIG. 1.
Figure 3:
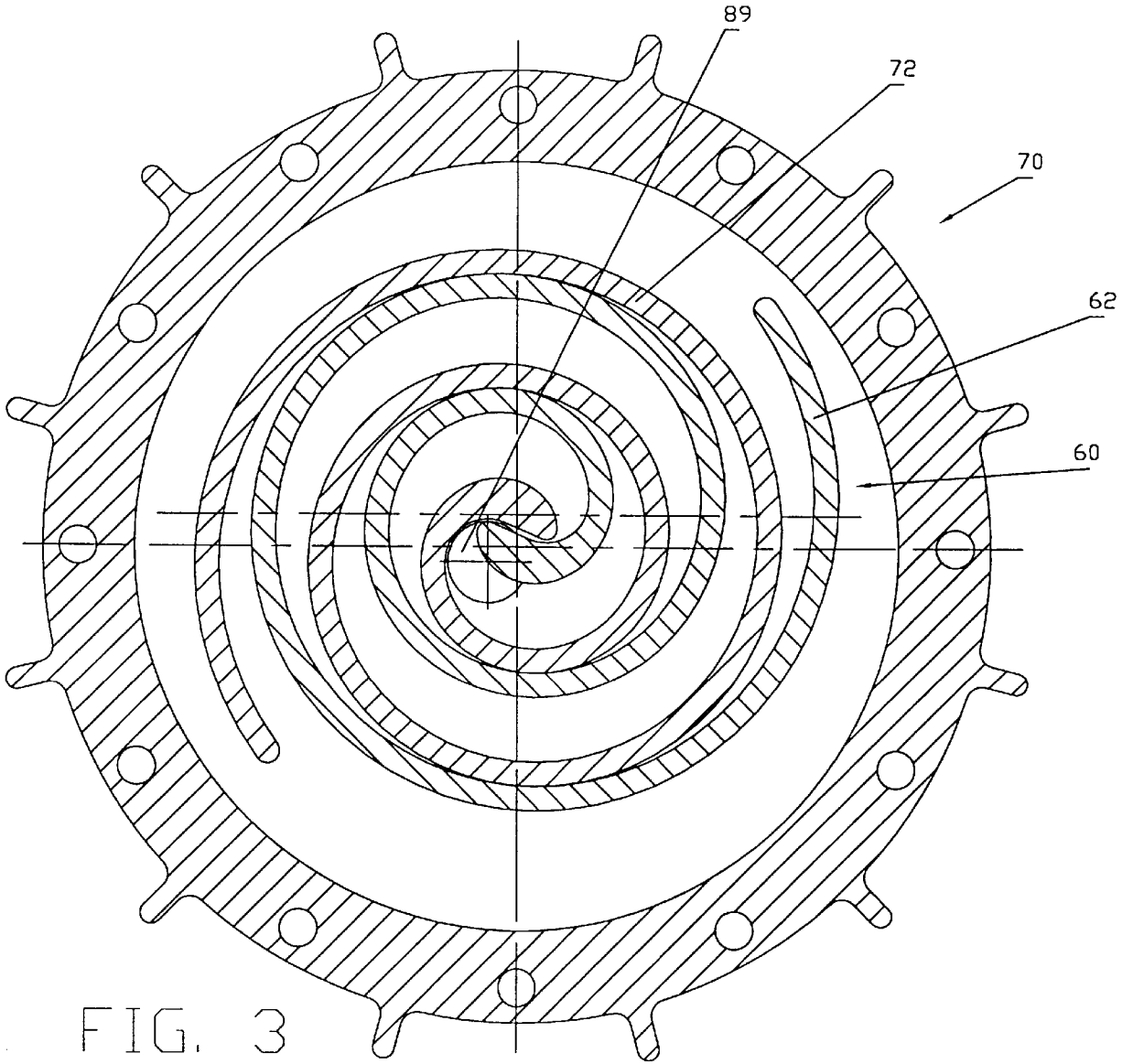
FIG. 3 is a cross-sectional view taken transversely through the pump of FIG. 1 along line 3—3 of FIG. 1.

Referring now to FIGS. 1–3, a scroll-type vacuum pump constructed in accordance with the present invention is shown generally at 10. The vacuum pump 10 includes a main housing 20 which contains a main shaft 22 supported by a bearing 30. A first scroll member 40 and a fourth scroll member 70 are bolted to the front and rear ends of the main housing 20, respectively. A front bearing housing 90 is bolted to the first scroll member 40.

The front bearing housing 90 holds a front shaft seal 92 and a front shaft bearing 94. The main shaft 22 is rotatably supported by the bearing 30 and the bearing 94, and rotates along its axis S1—S1 when driven by an electric motor (not shown) through a pulley 96. The shaft seal 92 seals the shaft 22 to prevent outside air and dirt from entering the pump 10.

The main shaft 22 includes a front crank pin 24 and a rear crank pin 26. The central axis S2—S2 of the front crank pin 24 is offset from the main shaft axis S1—S1 by a distance equal to the orbiting radius $R_{or1}$ of a second scroll member 50. The central axis S3—S3 of the rear crank pin 26 is offset from the main shaft axis S1—S1 by a distance equal to the orbiting radius $R_{or2}$ of a third scroll member 60. The orbiting radii $R_{or1}$ and $R_{or2}$ are the radii of the orbiting circles which are traversed by the second scroll member 50 and the third scroll member 60 as they orbit relative to the first scroll member 40 and fourth scroll member 70, respectively.

The first and the second scroll members 40 and 50, together, form the first stage of the vacuum pump 10, the expander. The first scroll member 40, also called the expander fixed scroll, includes a circular end plate 41 having a base surface from which a first scroll element 42 extends. In addition to the circular end plate 41 and the first scroll element 42, the first scroll member 40 includes an axially protruding front end 43 to which the front bearing housing 90 is attached.

The second scroll member 50, also called the expander orbiting scroll, includes a circular end plate 51, a second scroll element 52 and an orbiting bearing boss 53. The scroll element 52 is affixed to, and extends from, the front or base surface of the end plate 51. The orbiting bearing boss 53 is affixed to, and extends from, the front surface of the end plate 51. It could also extend from the rear surface of the end plate 51 in a more traditional design.

Scroll elements 52 and 62 are interfit at a 180 degree angular offset and at a radial offset equal to the orbiting radius $R_{or1}$. At least one pair of sealed off fluid pockets is thereby defined between the scroll elements 52 and 62, and the end plates 51 and 61.

The second scroll member 50 is connected to a driving pin 24 through a front driving pin bearing 27 and front driving slider 28. A front oldham ring 29 prevents rotation of the second scroll member 50. Therefore, when the second scroll member 50 is driven in an orbital motion at the orbiting radius $R_{or1}$, it is effective to expand fluid in the pockets when the drive shaft 22 is rotated.

The third and the fourth scroll members 60 and 70, together, form the second stage of the vacuum pump 10, the compressor. The third scroll member 60, also called the compressor orbiting scroll, has a circular end plate 61 with a base surface from which a third scroll element 62 extends. An orbiting bearing boss 63 is affixed to, and extends from, the front surface of the end plate 61. The fourth scroll member 70, also called the compressor fixed scroll, includes a circular end plate 71, a fourth scroll element 72, a discharge hub 73 and reinforcing ribs 74.

Scroll elements 62 and 72 are interfit at a 180 degree angular offset, and at a radial offset equal to the orbiting radius $R_{or2}$. At least one pair of sealed off fluid pockets is thereby defined between scroll elements 62 and 72 and end plates 61 and 71. The third scroll member 60, is connected to driving pin 26 through a rear driving pin bearing 31 and rear driving slider 32. A rear oldham ring 33 prevents rotation of the third scroll member 60, whereby it is driven in an orbital motion to thereby compress fluid at the orbiting radius $R_{or2}$ when the drive shaft 22 is rotated.

In operation of the compressor 10, air enters the inlet chamber 81 from the intake port 80. From the inlet chamber 81, the air travels to the suction pockets 82 formed by the first and second scroll members 40 and 50. This air then is expanded by the operation of these two scroll members. The expanded air is discharged through chamber 84, chamber 85 and passage 86 to the suction chamber 87 of the second stage of the vacuum pump, the compressor.

The air in the suction chamber 87 then enters the suction pockets formed by the third and fourth scroll members 60 and 70, where it is compressed by the operation of these two scroll members. The compressed air opens the discharge valve 88 and escapes to ambient from the discharge hole 89 and the discharge port 98.

Figure 4C:
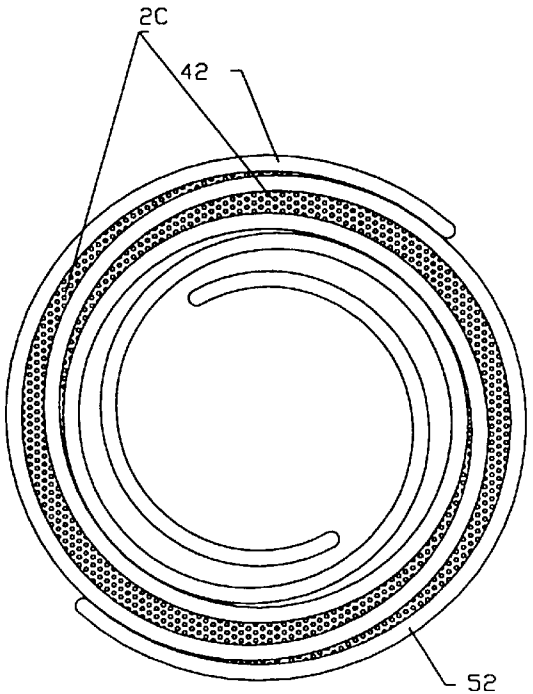
FIGS. 4*a*–4*c* illustrate the work principle of the first stage of the pump, in accord with the present invention.
Figure 4B:
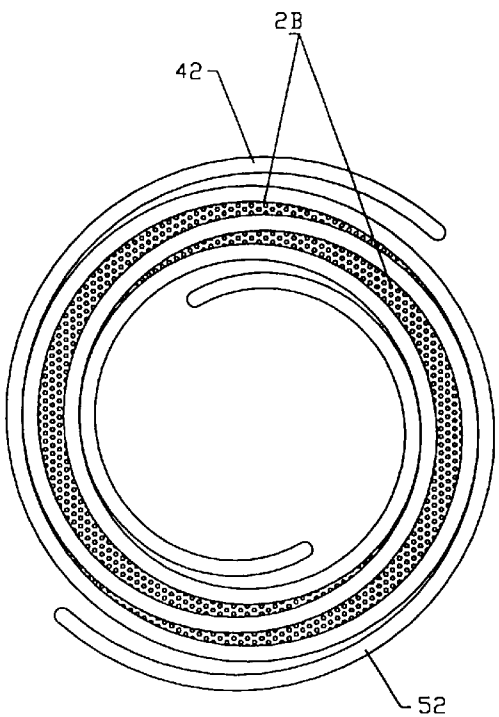
Figure 4A:
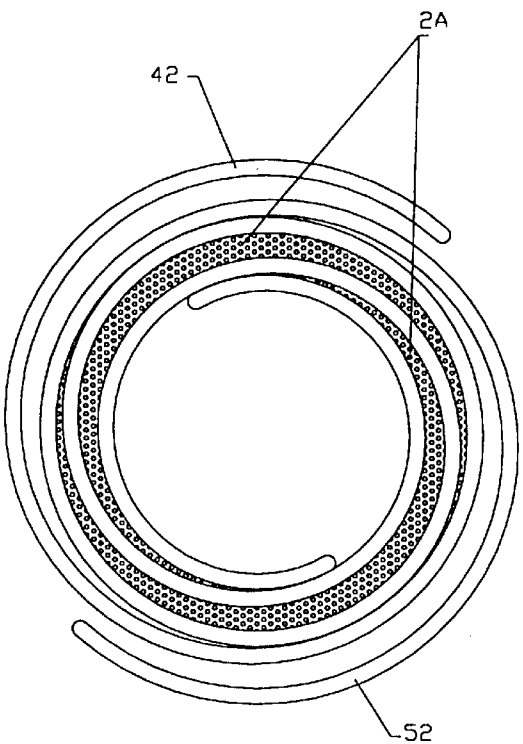

FIGS. 4*a*–4*c* schematically illustrate the relative movement of interfitting, spiral-shaped scroll elements 42 and 52 of the first and the second scroll members 40 and 50, respectively. In FIG. 4*a*, the suction pockets of the expander are shown at 2A. The suction pockets 2A are the innermost pockets formed by the two scroll elements 42 and 52 when the sides of one scroll element are in contact with the sides of the other scroll element and the tip of each scroll elements is in contact with the base surface of the end plate in the opposite member. The total volume of the suction pockets is called suction volume.

Referring now to FIGS. 4*b* and 4*c*, 2B indicates the pockets during the expansion process and 2C indicates the discharge pockets of the expander. The discharge pockets 2C are the outermost pockets formed by the two scroll elements 42 and 52 just before the sealed pockets open to discharge. The volume of the discharge pockets is called discharge volume.

Figure 5C:
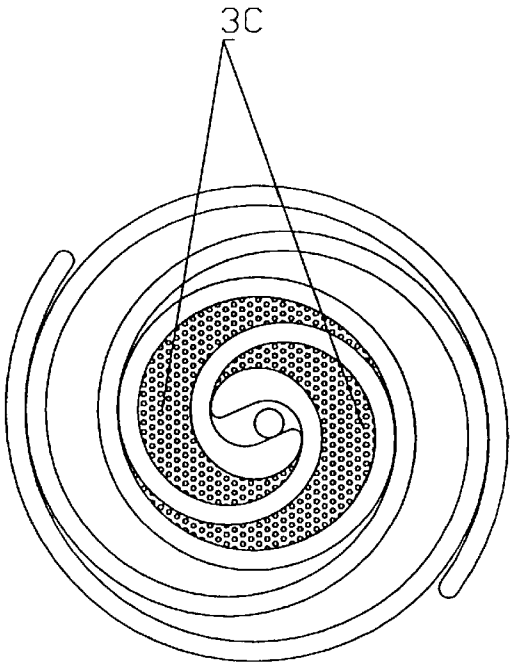
FIGS. 5*a*–5*c* illustrate the work principle of the second stage of the pump, in accord with the present invention.
Figure 5B:
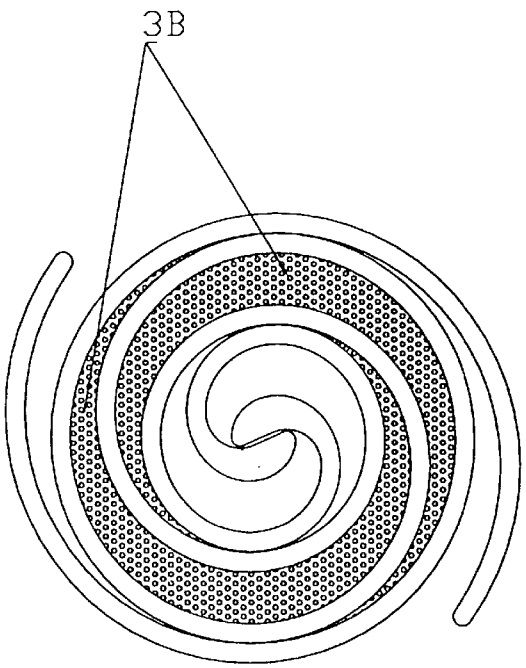
Figure 5A:
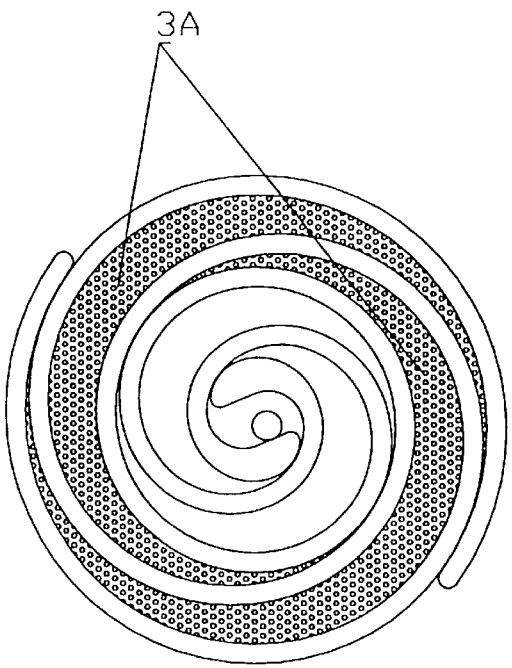

FIGS. 5*a*–5*c* schematically illustrate the relative movement of scroll elements 62 and 72 of the third and the fourth scroll members 60 and 70, respectively. The suction pockets 3A, formed by the third and the fourth scroll members 60 and 70, are the pair of outermost pockets of the compressor. The pocket undergoing the compression process is shown at 3B in FIG. 5*b*. Referring to FIG. 5*c*, the discharge volume, i.e., the volume of the innermost pockets of the compressor, is seen at 3C.

The relationships of the suction and discharge pockets in the compressor stage of the vacuum pump 10 are opposite to that in the expander stage. According to the present, the volume 3A in the compressor stage must not be significantly smaller than the volume 2C in the expander stage. Preferably, that volume 3A is equal to or greater than 2C.

The relationship between the discharge volume of the expander and the suction volume of the compressor is thus important to the performance of the vacuum pump. Air which discharges from the discharge pockets of the first stage, the expander, is sucked in by the suction pockets of the second stage, the compressor. At steady state, the law of mass conservation gives the following relationship:

$$D_{2c}*V_{2c}=D_{3a}*V_{3a} \quad (1),$$

where $D_{2c}$ and $D_{3a}$ are the densities of the air in the discharge pockets of the expander stage and in the suction pockets of the compressor stage, respectively, and $V_{2c}$ is the discharge volume of the expander stage while $V_{3a}$ is the suction volume of the compressor stage. If the suction volume of the second stage, $V_{3a}$, is less than the discharge volume of the first stage, $V_{2c}$, i.e., if $$V_{3a}<V_{2c} \quad (2),$$

then $$D_{3a}>D_{2c} \quad (3),$$

and, assuming constant temperature of the air in both volumes, the state equation for an ideal gas leads to the following:

$$P_{2c}/D_{2c}=P_{3a}/D_{3a} \quad (4).$$

Therefore, $$P_{3a}>P_{2c} \quad (5).$$

Since the air pressure in the chambers 84, 85 and 86 is P3*a*, the air in the discharge pockets of the expander is over-expanded. The air in chambers 84, 85 and 86 will re-expand to the discharge pockets as soon as the discharge pockets of the expander open to the chamber 84. Repetitive re-expansion can overheat both the expander and the compressor.

If V3*a* is not significantly smaller than V2*c*, the heat generated by the re-expansion of the air may be dissipated to the ambient through the housing and other parts, and overheating might not happen. However, if $$V_{3a}\geqq V_{2c} \quad (6),$$

overheating will never happen.

Thus, the invention contemplates a vacuum pump 10 in which operation always produces a suction volume of the second stage which is greater than the discharge volume of the first stage. That is achieved by using the expander-compressor construction hereinbefore described.

In another aspect of the invention, optimum shaft sealing is achieved. Referring to FIG. 1, the shaft seal 11 is illustrated. The shaft seal 11 comprises a spring seat 12, a spring 13, a rotating ring 14, an "O" ring 15, an orbiting ring 16 and an orbiting "O" ring 17. The orbiting ring 16 seals off the air passage between the front driving pin bearing 27 and the orbiting bearing boss 53. The "O" ring 15 seals off the air passage along the surface of shaft 22. The rotating ring 14 is pushed by spring 13 against orbiting ring 16 to form an air tight contact surface 18. This contact surface 18 seals off any possible air passage along the shaft between inlet chamber 81 and chamber 85.

The uniqueness of shaft seal 11 resides in the fact that the relative motion between the rotating ring 14 and orbiting ring 16 is a combination of shaft rotation and the orbiting motion of the orbiting ring 16. A conventional shaft seal 92 is used to seal off chamber 81 from the possible air leakage through the front bearing housing 90 to ambient. Seals 11 and 92, in combination, form the seal mechanism in accord with the present invention.

Another aspect of the invention is found in the scroll element tip sealing area. Referring to FIGS. 6*a*–6*f*, labyrinth lips 301, 302, 303, 304 on a tip 300 (only a portion of which is shown) of a scroll element are illustrated. The labyrinth lips are very thin, shallow walls formed on the tips of the scroll elements. They are designed to block the air flow in radial and tangential directions. However, when the labyrinth lips formed unitarily with the tip of the scroll element are urged against the base surface of the other scroll member due to thermal growth of the scroll elements as the device operates, the labyrinth lips easily bend, otherwise deform or are removed by contact with the base surface. This avoids tip-base surface galling.

Figure 6B:
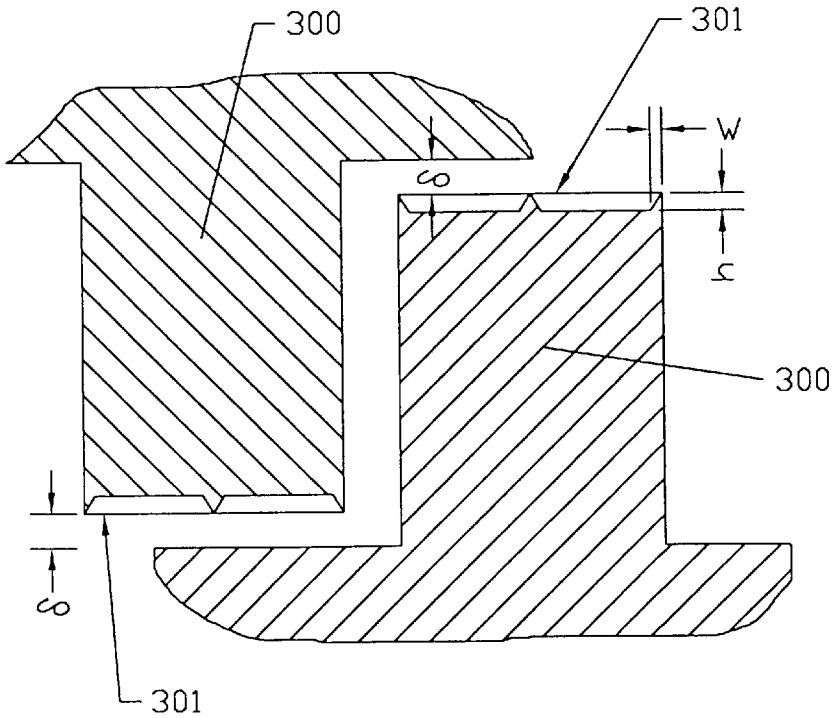
FIGS. 6*a*–6*f* illustrate various embodiments of labyrinth lips formed on the tips of scroll elements, in accord to the present invention.
Figure 6A:
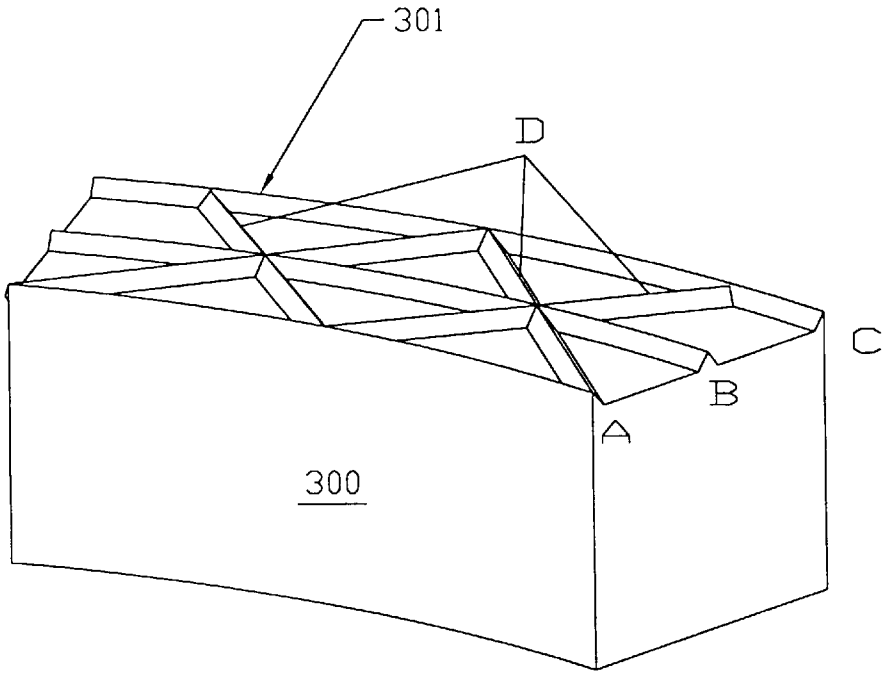

FIG. 6*a* shows one form of the labyrinth lips 301. The lips have three longitudinal walls A, B and C, formed unitarily with and located at both sides and in the middle of the tip 300 of the spiral scroll element. They are connected by diagonal walls D. The lips have a triangular cross section i.e., a narrow peak and a wider bottom, and the width w and the height h of each (see FIG. 6*b*) is small, e.g., 0.5 mm.

Other geometric configurations or cross sections of the labyrinth lips are possible, as long as they have weak peaks. Their peaks are easily bent, deformed or removed without galling the base surface of the mating scroll. A very small axial gap δ, even zero gap, between the tips and base surfaces is maintained. Thus, excellent radial and tangential sealing is provided.

Figure 6C:
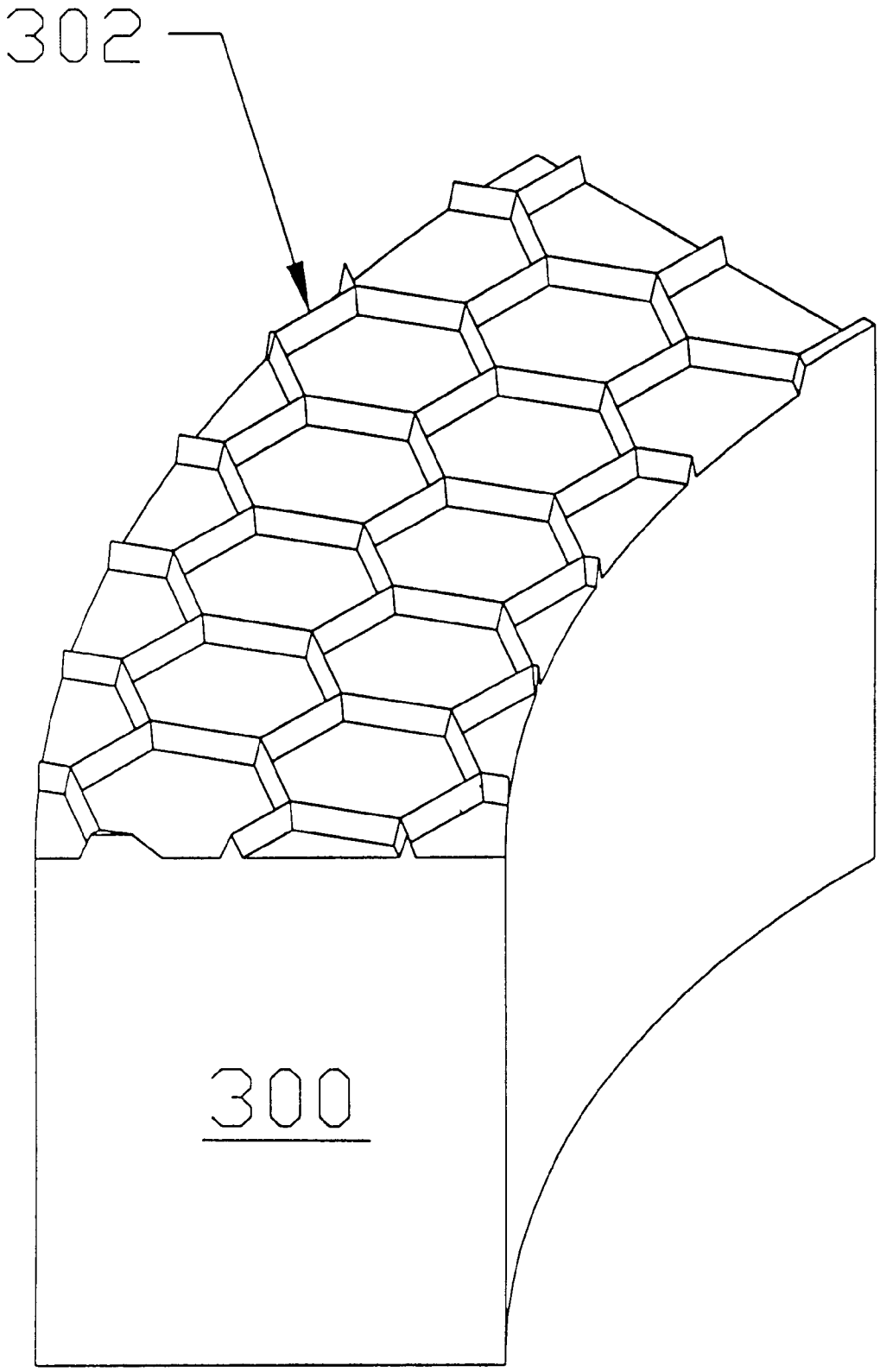
Figure 6D:
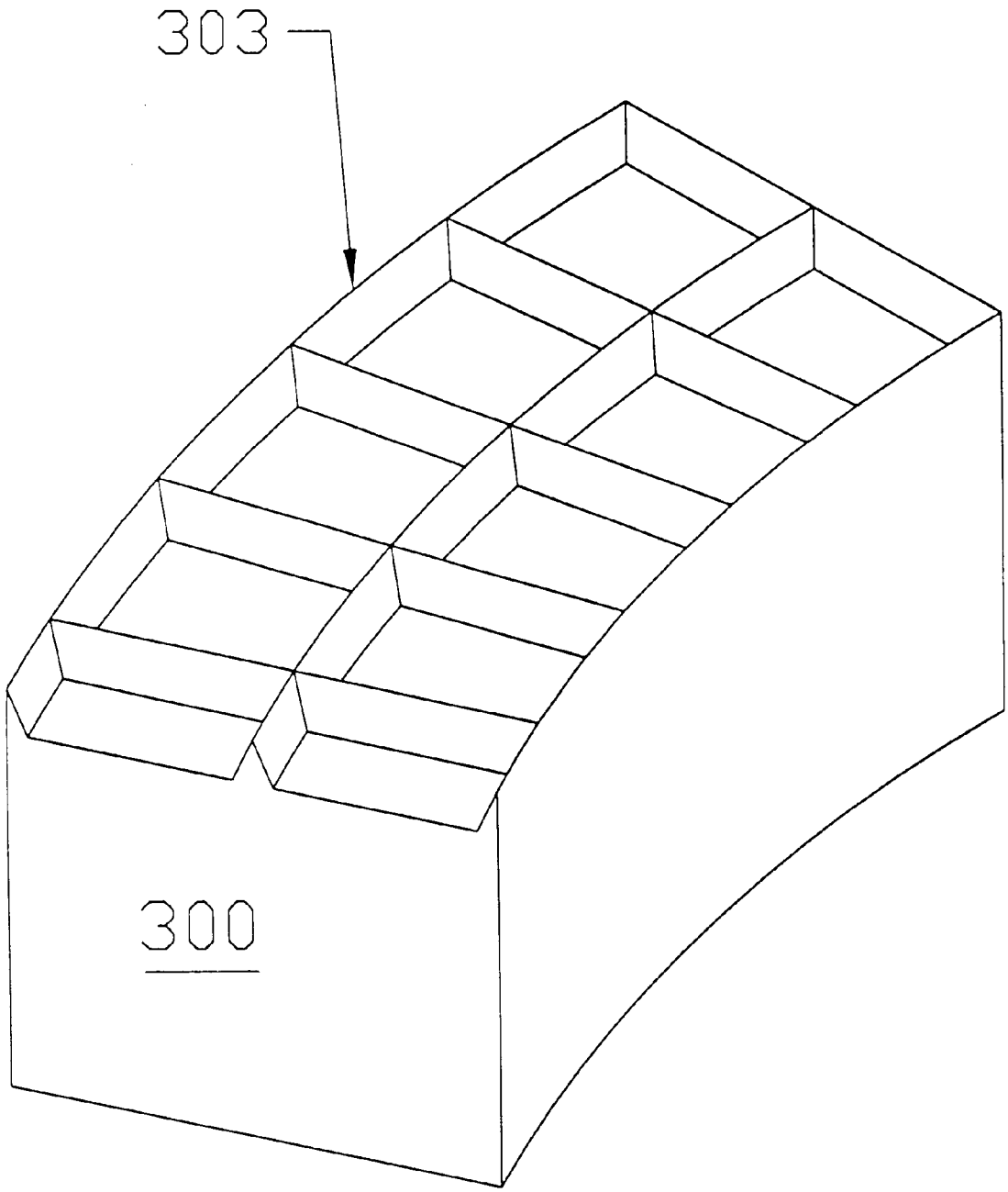
Figure 6F:
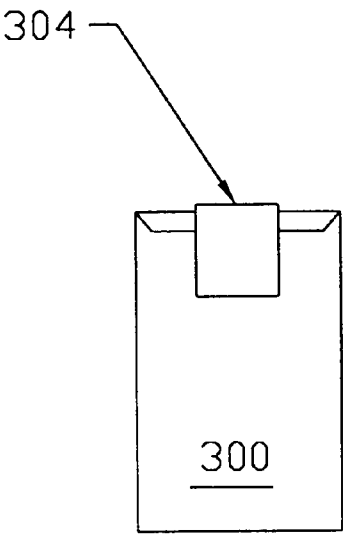
Figure 6E:
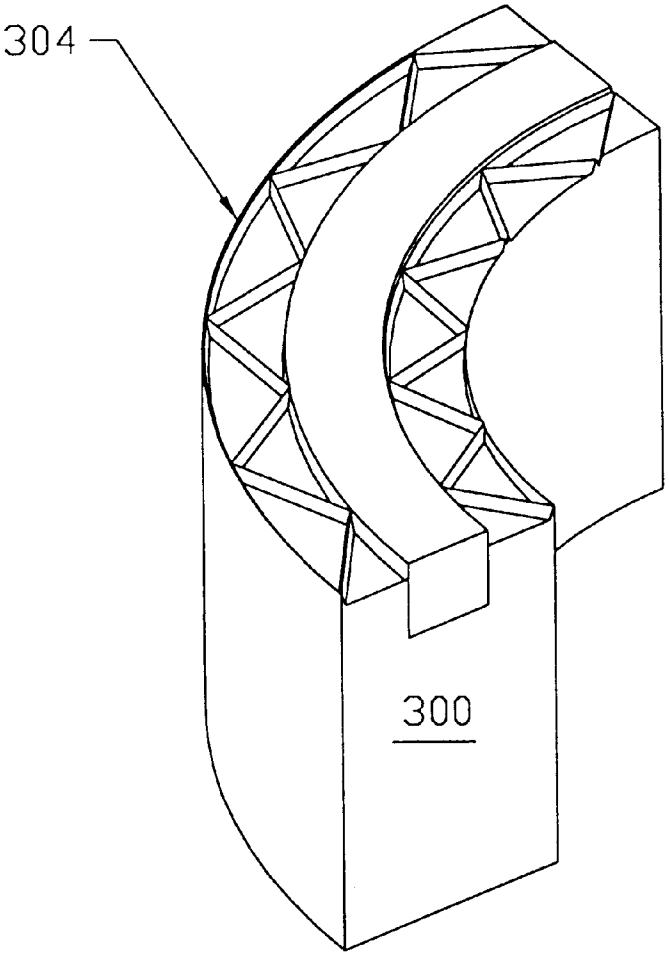
Figure 7:
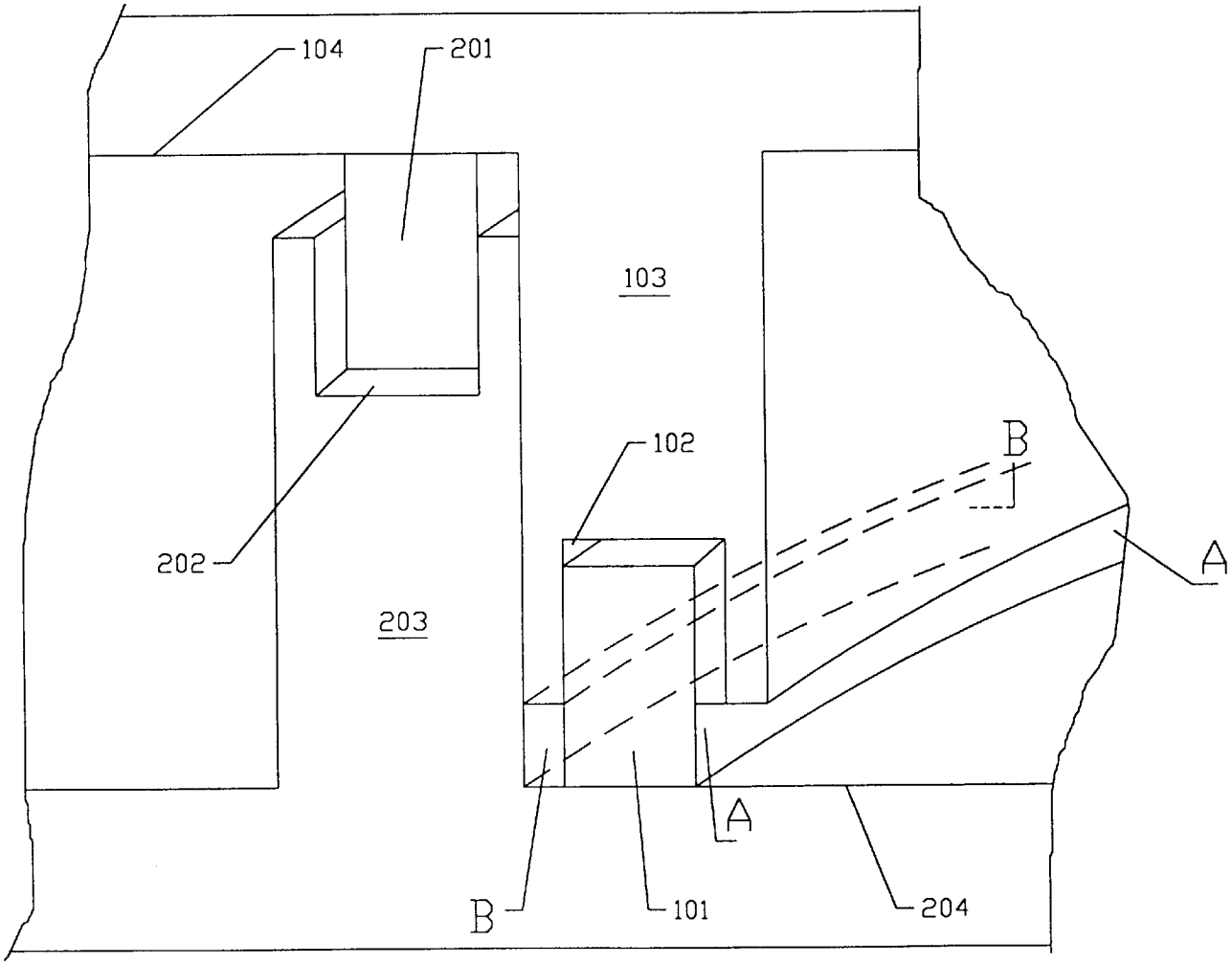
FIG. 7 PRIOR ART
FIG. 7 is an illustration of a prior art device.

FIGS. 6*c* and 6*d* show comb-shaped and square-shaped labyrinth lips 302, 303, respectively. FIGS. 6*e* and 6*f* show a combination of the labyrinth lips 304 with a conventional tip seal mechanism.

While the above-described embodiments of the invention are preferred, those skilled in this art will recognize modifications of structure, arrangement, composition and the like which do not part from the true scope of the invention. The invention is defined by the appended claims, and all devices and/or methods that come within the meaning of the claims, either literally or by equivalents, are intended to be embraced therein.

I claim:

1. A scroll-type fluid displacement device, comprising:

a) a first scroll member including an end plate from which a scroll element projects axially;

b) a second scroll member including an end plate from which a scroll element projects axially;

c) each of said end plates having a base surface;

d) each of said scroll elements having opposite sides and a tip;

e) each of said tips including a plurality of sealing lips formed unitarily therewith, said sealing lips comprising axially extending walls which are easily deformable.

2. The device of claim 1 further characterized in that:

a) the axial height and radial width of each of said walls is about 0.5 mm or less.

3. The device of claim 1 further characterized in that:

a) said plurality of sealing lips form a labyrinth of sealing lips on each of said tips.

4. The device of claim 3 further characterized in that:

a) said labyrinth of sealing lips extended across substantially the entire width of each of said tips between opposed sides of the corresponding scroll element.

5. A scroll-type fluid displacement device, comprising:

a) a first scroll member including an end plate from which a scroll element projects axially;

b) a second scroll member including an end plate from which a scroll element projects axially;

c) each of said end plates having a base surface;

d) each of said scroll elements having a tip formed unitarily therewith;

e) the tip of each scroll element in each of the first and second scroll members extending into immediately adjacent relationship with the base surface of the other of the first and second scroll members during operation of the device;

f) each of said tips including a plurality of sealing lips formed unitarily therewith, said sealing lips comprising axially extending walls which are easily deformable and adapted to deform when they engage opposed base surfaces during operation of the device.

6. The device of claim 5 further characterized in that:

a) said axially extending walls have relatively wider bottoms and relatively narrower tops;

b) said narrower tops being deformable.

7. A scroll-type displacement apparatus, comprising:

a) a first scroll member including an end plate and a scroll element, said scroll element in said first scroll member projecting axially from a base surface on said first scroll member end plate;

b) a second scroll member including an end plate and a scroll element, said scroll element in said second scroll member projecting axially from a base surface on said second scroll member end plate;

c) each of said scroll elements having a tip including a labyrinth of axially projecting walls formed unitarily with the tip, said scroll members being mounted in opposed relationship to each other so that the axially projecting walls of the labyrinth on each scroll element tip extend into immediately adjacent relationship with the base surface of the end plate on the opposite scroll member;

d) said axially projecting walls in each labyrinth having free ends which are thin and easily deformable whereby, during operation, their deformation assures effective sealing without galling taking place as heat causes said scroll members to expand.

8. A scroll-type fluid displacement device, comprising:

a) a first scroll member including an end plate from which a scroll element projects axially;

b) a second scroll member including an end plate from which a scroll element projects axially;

c) each of said end plates having a base surface;

d) each of said scroll elements having a tip formed unitarily therewith;

e) the tip of each scroll element in each of the first and second scroll members extending into immediately adjacent relationship with the base surface of the other of the first and second scroll members during operation of the device;

f) each of said tips including a plurality of sealing lips thereon, said sealing lips comprising axially extending walls which are adapted to deform when they engage opposed base surfaces during operation of the device;

g) said axially extending walls having relatively wider bottoms and relatively narrower tops so as to be generally triangular in cross-section.

9. A scroll-type fluid displacement device, comprising:

a) a first scroll member including an end plate from which a scroll element projects axially;

b) a second scroll member including an end plate from which a scroll element projects axially;

c) each of said end plates having a base surface;

d) each of said scroll elements having opposite sides and a tip;

e) each of said tips including a plurality of sealing lips thereon, said sealing lips comprising axially extending walls which are deformable;

f) said axially extending walls being generally triangular in cross-section so as to have relatively wider bottoms and relatively narrower peaks.

10. A scroll-type fluid displacement device, comprising:

a) a first scroll member including an end plate from which a scroll element projects axially;

b) a second scroll member including an end plate from which a scroll element projects axially;

c) each of said end plates having a base surface;

d) each of said scroll elements having opposite sides and a tip;

e) each of said tips including a plurality of sealing lips thereon, said sealing lips comprising axially extending walls which are deformable;

f) said plurality of sealing lips forming a labyrinth of sealing lips on each of said tips;

g) a groove formed into each of said tips between said opposed sides of the corresponding scroll element; and h) a seal element seated in each groove for axial movement therein.

11. The device of claim 10 further characterized in that:

a) said seal element has a flat sealing surface.

12. The device of claim 11 further characterized in that:

a) said seal element comprises about 30% carbon fiber and about 70% Teflon.

* * * * *